United States Patent [19]

Mennella

[11] Patent Number: 5,018,876

[45] Date of Patent: May 28, 1991

[54] DIVIDED SEPARABLE TRASH BAG

[76] Inventor: Robert M. Mennella, Kensington Station 419 McDonald Ave., Brooklyn, N.Y. 11218

[21] Appl. No.: 459,659

[22] Filed: Jan. 2, 1990

[51] Int. Cl.[5] ..... B65D 30/02; B65D 30/22

[52] U.S. Cl. ..... 383/1; 220/909; 383/37

[58] Field of Search ..... 383/1, 37; 220/23.4, 220/DIG. 30, 909, 1 T; 206/602

[56] References Cited

U.S. PATENT DOCUMENTS

| | | | |
|---|---|---|---|
| 2,805,814 | 9/1957 | Calasibetta et al. | 206/602 |
| 3,339,824 | 9/1967 | Luke | 383/37 |
| 3,762,454 | 10/1973 | Wilkins, Jr. | 383/1 |
| 3,903,029 | 9/1975 | Young | 252/525 |
| 4,610,358 | 9/1986 | Walter | 383/1 |
| 4,660,758 | 4/1987 | Tavel et al. | 209/933 |
| 4,696,403 | 9/1987 | Hoover | 206/602 |
| 4,729,489 | 3/1988 | Papaianni | 220/23.8 |
| 4,874,134 | 10/1989 | Wiens | 71/14 |

*Primary Examiner*—Stephen P. Garbe

*Attorney, Agent, or Firm*—Ostrolenk, Faber, Gerb & Soffen

[57] ABSTRACT

A trash bag that has separable compartments that are connected by plastic zippers.

The object of the invention is to enable an individual to separate trash in one receptacle. One separable half is to be made of bio-degradable plastic for perishable trash and the other separable half made of recyclable plastic for recyclable trash.

12 Claims, 1 Drawing Sheet

DIVIDED SEPARABLE TRASH BAG

FIELD OF THE INVENTION:

The invention relates to a trash bag, and in particular a trash bag with separate compartments which can be pulled apart to form two bags.

SUMMARY OF THE INVENTION

As a growing concern over the problem of where to put solid waste erupts, the object of the principal invention is to ease the burden of separating our recyclable trash from our perishable trash. It is prevalent that there is an increasing awareness among individuals to do his/her part to help preserve the environment for future generations to come.

A further object of the invention is to provide an incentive we need to do our share to curb the build up of solid waste. Laws have been passed in some states which require the separation of trash. The invention will allow the individual to use the same container for that separation, thereby eliminating the need for two receptacles.

According to a feature of the , a trash bag is divided and separable into two individual halves.

This feature enables an individual to separate recyclable trash from perishable trash all in the same receptacle. Perishable trash will be placed in one side which will be made of a bio-degradable plastic, and recyclable trash such as bottles, cans and paper will be placed in the other side which will be made of a recyclable plastic.

The disclosed embodiment of the invention is actually two bags connected by two vertical plastic zippers centered between. The composition of each zipper half will be the same as that of the bag it is attached to. In other words, the bio-degradable plastic bag will have two bio-degradable zipper halves that will fit into the recyclable zipper halves of the other bag.

Trash can be put in the same container but in separate compartments formed by the two halves of the bag. The invention can then be removed as a whole and be separated by pulling apart both halves simutaneously which have been held together by the plastic zippers. The result is two bags, one bag holding perishable trash in a bio-degradable plastic and the other bag holding recyclable trash in a recyclable plastic.

The invention is generally for use in the kitchen trash can to prevent the unsightliness of two receptacles and to promote convenience and cleanliness.

BRIEF DESCRIPTION OF THE DRAWINGS:

FIG. 2 shows the zipper half way closed and FIG. 3 is an extreme close up showing how the zipper interlocks.

DETAILED DESCRIPTION

Figure 1:
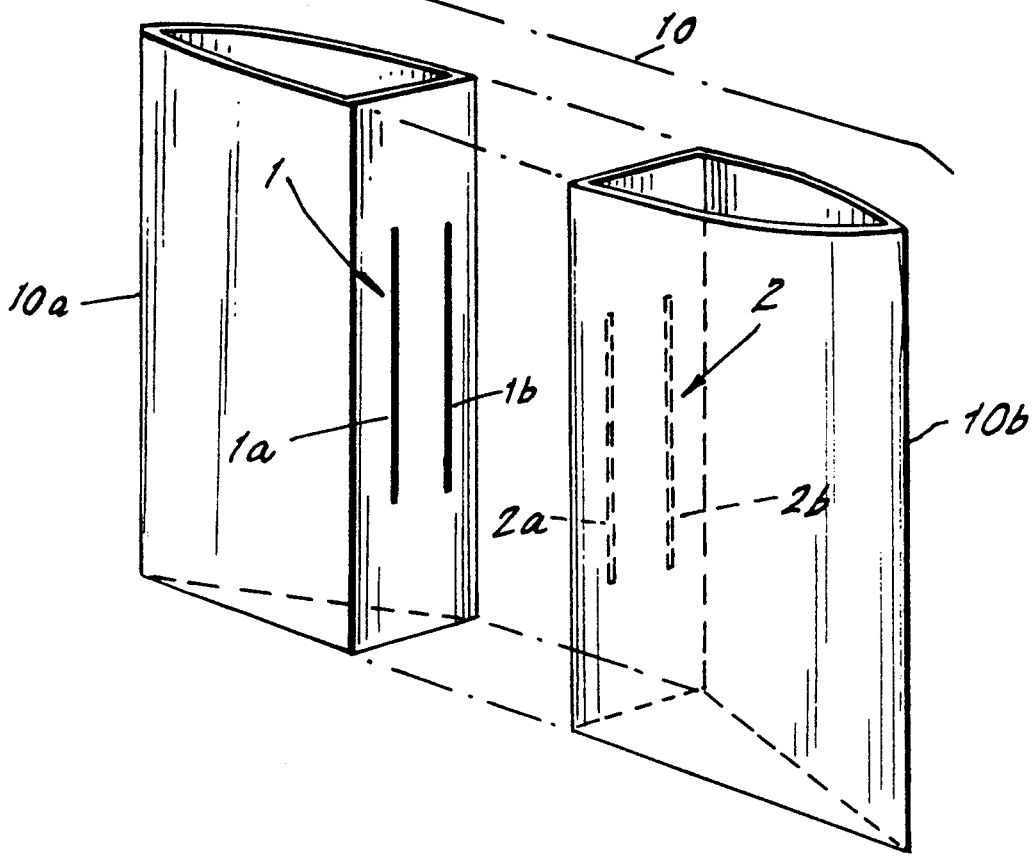
FIG. 1 shows an embodiment of the invention as it appears after post-separation of the two halves with reference numerals 1 and 2 referring to respective halves of the plastic zippers.

Referring to FIG. 1, the disclosed embodiment of the invention is a trash bag 10 with two compartments 10*a* and 10*b* which can be separated. The trash bag 10 is held together by two plastic zippers 1*a*, 2*a* and 1*b*, 2*b*. The invention can be described as one bag that can be separated into two, or two bags that can be connected to form one. Either way, the main objective of the invention is to enable an individual to separate trash in one receptacle by forming two compartments.

Figure 2:
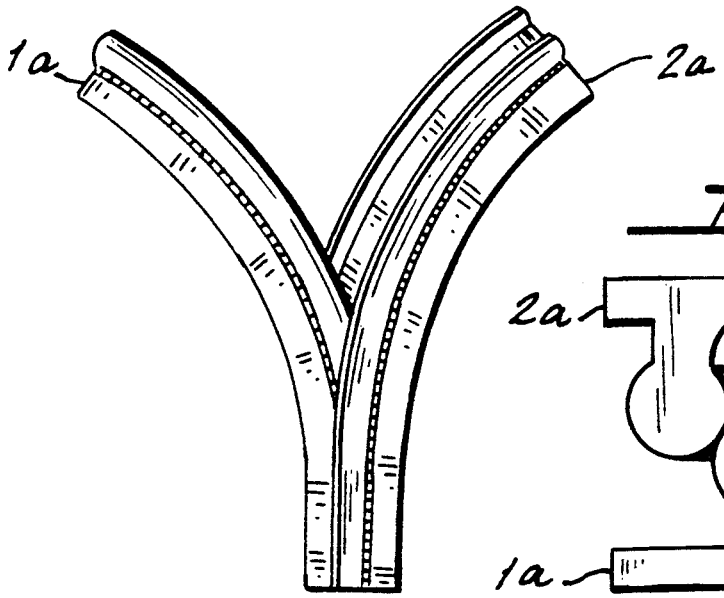
FIGS. 2 and 3 are two drawings showing close up views of a plastic zipper.
Figure 3:
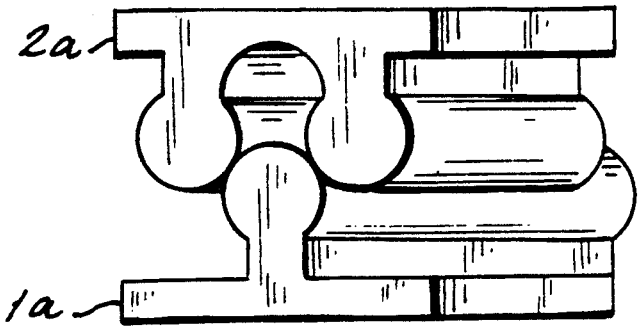

Referring to FIGS. 2 and 3, one of the zippers comprises a male half 1*a* and a female half 2*a*. A suitable location and length for the zippers is shown in FIG. 1.

The manner and process of making the disclosed trash bag it will be a typical plastic extrusion method used in making plastic trash bags. The composition of matter will be, in one trash bag half, bio-degradable plastic, and in the other trash bag half, recyclable plastic.

I claim:

1. A divided trash bag comprising:

first and second bag halves, having at least first and second respective side surfaces;

first connecting means on the first side surface and second connecting means on the second side surface, said first and second connecting means being readily connected to and disconnected from each other for attaching and separating said two bag halves;

said first bag half and first connecting means being made of a biodegradable plastic.

2. A divided trash bag as in claim 1, wherein said second bag half and second connecting means are made of a recyclable but substantially non-biodegradable plastic.

3. A divided trash bag as in claim 1, wherein said first and second connecting means include a male half and a female half of at least one plastic zipper which readily connect to and disconnect from each other.

4. A divided trash bag as in claim 3, wherein each said bag half and its corresponding plastic zipper half are integrally formed by extrusion.

5. A divided trash bag as in claim 3, wherein the side surface of each bag half is configured and dimensioned to mate with the side surface of the other bag half thereby defining a mating area, with the zipper half on the first bag half connected to the zipper half on the second bag half.

6. A divided trash bag as in claim 5, wherein said first and second side surfaces are elongated and define a longitudinal direction, and said zipper halves extend in said longitudinal direction.

7. A divided trash bag as in claim 6, wherein said bag halves have a substantially horizontally extending closed bottom and said first and second side surfaces extend substantially vertically, and said zipper halves extend substantially vertically on said side surfaces.

8. A divided trash bag as in claim 6, wherein said zipper halves extend substantially vertically on said side surfaces.

9. A divided trash bag as in claim 8, wherein said zipper halves extend over substantially half of the vertical dimension of said side surfaces.

10. A divided trash bag as in claim 9, wherein said zipper halves are vertically centered midway between the longitudinal extremities of said side surfaces.

11. A divided trash bag as in claim 8, further comprising a second pair of plastic zipper halves which are disposed on said side surfaces which so as to be connectable together when said first-mentioned zipper halves are connected together.

12. A divided trash bag as in claim 11, wherein said first and second pair of zipper halves are substantially centered about an imaginary vertical median line of said mating area.

* * * * *